US006027319A

United States Patent [19]

Winefordner et al.

[11] Patent Number: 6,027,319

[45] Date of Patent: Feb. 22, 2000

[54] COMPACT MANUAL AIR PUMP HAVING SELECTABLE HIGH VOLUME AND HIGH PRESSURE MODES

[76] Inventors: Carl Winefordner; Frank Hermansen, both of 548 Seaward Rd., Corona Del Mar, Calif. 92625

[21] Appl. No.: 08/845,068

[22] Filed: Apr. 21, 1997

Related U.S. Application Data

[63] Continuation-in-part of application No. 08/680,749, Jul. 15, 1996, Pat. No. 5,676,529.

[51] Int. Cl.[7] ..... F04B 1/02; F04B 23/00

[52] U.S. Cl. ..... 417/440; 417/468; 417/528

[58] Field of Search ..... 417/251, 253, 417/259, 262, 263, 460, 468, 469, 440, 528, 530

[56] References Cited

U.S. PATENT DOCUMENTS 5,779,457 3/1996 Chuang et al. ..... 417/467

*Primary Examiner*—Charles G. Freay

*Attorney, Agent, or Firm*—Leonard Tachner

[57] ABSTRACT

A pump comprises a pair of coaxial pistons, one slidably positioned in the other for simultaneous compression causing similarly directed air flow, independent passages and valves for permitting air flow from each piston into the pump head for increased air flow, and a switching device for selectively opening one passage to ambient to decrease the air flow into the pump head. The pump thus has two modes, namely a high volume mode when the two pistons operate simultaneously to direct combined air flow and a high pressure mode when the passage is opened to ambient to direct air flow from only one of the two pistons.

3 Claims, 6 Drawing Sheets

COMPACT MANUAL AIR PUMP HAVING SELECTABLE HIGH VOLUME AND HIGH PRESSURE MODES

CROSS-REFERENCE TO RELATED APPLICATIONS

This application is a continuation-in-part of application Ser. No. 08/680,749 filed on Jul. 15, 1996 and now issued under U.S. Pat. No. 5,676,529 issued Oct. 14, 1997.

FIELD OF THE INVENTION

The invention relates to a compact dual-mode manual pump such as for inflating bicycle tires and that in one mode provides a very high volume of air per pump stroke and in another mode provides less volume per stroke but enables the user to inflate to higher pressures.

PRIOR ART

Bicycle pumps are typically made in two varieties: 1) Big bore for high volume per stroke and low pressure (up to about 50 psi generally used for tires with large cross-sectional diameters such as tires for mountain bikes); and 2) small bore for low volume per stroke and high pressure (up to about 120 psi generally used for tires with smaller cross-sectional diameters such as tires for road bikes).

The weight and size of objects carried with the bicyclist affects the amount of work required to propel the bicycle. Greater weight increases rolling resistance, reduces acceleration, and increases the work to ascend hills. Greater size can increase wind resistance and is a greater problem to carry. A pump is an item that many bicycling enthusiasts consider essential to carry in case of a flat tire and they prefer to carry the most size and weight efficient pump possible. One way to measure efficiency is by comparing the volume of air pumped per stroke to the overall size of the closed pump.

In an attempt to increase the volume per stroke in portable hand pumps, some pumps are telescoping; that is they have a sliding chamber and piston within a sliding chamber and piston. Unfortunately, this also increases the stroke length excessively and does nothing to allow a selection between pumping air to low pressures at high volume per stroke and high pressures with low volume per stroke. Another attempt to increase the volume per stroke is a double action pump; that is the pump pushes air into the tire on both the push and pull motion of the stroke. One problem with this is that people do not have the same physical strength in the pushing and pulling motions. People are generally stronger pushing. The pressure that can be reached is limited by the pulling strength. Therefore a pump of a given diameter cannot achieve as high a pressure as a single action pump. Secondly, as with the telescoping pump, it is fixed at a given volume per stroke. Lastly, many people do not like to use a double action pump because they find it uncomfortable to use.

Generally when pumping a tire to say, 100 psi with a bicycle pump, the effort per stroke required starts at near zero and ends at a relatively high level. When the tire is empty or at low pressure, there is very little force required to push air into it. As the pressure in the tire increases, the force increases in direct proportion. The force is equal to the pressure times the piston area (neglecting a small amount of friction).

It is frustrating to pump up a high pressure tire with a small bore pump because the first phase of inflation requires little force but many strokes. In fact, it takes over 200 strokes of some pumps to inflate a road bike tire to 100 psi (and over 400 strokes to inflate a mountain bike tire to 50 psi) and the first 100 strokes feel as if nothing is happening because the force exerted is so small. Even though the energy per stroke is small, this repeated motion is still tiring. Imagine for a moment rapidly waving your arms together and apart 100 times. No real work was accomplished but you will still feel exertion. It also takes time (which is especially important for cycling competitors). As the bore of the pump piston is increased in size, the volume per stroke increases as does the force required. For example, a pump with a piston diameter of 0.5" requires about 20 pounds of force to generate 100 psi. A pump diameter of 1.0" requires about 80 pounds of force to generate 100 psi, but pushes four times the volume of air per stroke. Most people are not strong enough to push a pump with 80 pounds of force repeatedly so high pressure pumps have small piston bore diameters and people are forced to accept that they will have to pump many easy strokes to inflate the tire to half of the desired pressure before incurring any significant resistance.

The following are patents which are considered relevant to the invention:

753,530 Ten Eyck 1,149,324 Baldwin et al 1,412,279 Eslinger 3,302,535 Procter et al 4,508,490 Ramirez et al 5,051,073 Newbold 5,165,876 Wang 5,443,370 Wang Of particular interest is U.S. Pat. No. 5,443,370 to Wang, which discloses a two cylinder telescoping air pump which pumps high volumes at low pressure when fully extended, and low volumes at high pressure when partially collapsed which is a short stroke configuration. Furthermore, the U.S. Pat. No. 4,508,490 to Ramirez et al, discloses a two stage manual air pump which can pump either high volumes at low pressure, or low volumes at high pressure. However, this pump is a very bulky and complex structure and is actually two distinct pumps mounted coaxially for very low pressures. In addition, U.S. Pat. No. 1,149,324 to Baldwin et al, discloses a cylindrical double-acting, compound air pump. The remainder of the above-listed patents were selected to further illustrate patents in the field of manual air pumps.

It would be desirable to have a pump that can pump a high volume of air per stroke for relatively low pressures and then be adjusted so as to pump a small volume of air per stroke for relatively high pressures. It would also be desirable if the adjustment from the high to low volume per stroke was simple. It would also be desirable if the pump, in its high volume mode, pumps a relatively high volume without increasing the stroke length substantially (as in the case with telescoping pumps). It would also be desirable to have a pump that can pump relatively large volumes of air per stroke for its overall size.

SUMMARY OF THE INVENTION

In the present invention, when inflating a tire, the user pumps using the high volume setting until either the desired pressure is reached or the effort becomes too high for that particular person. Then he or she switches the setting to low volume which causes the effort to decrease dramatically and he or she can continue to pump the tire up to the desired pressure. This results in an overall decrease in strokes and time to fill the tire without requiring excessive force.

In an alternative embodiment without the feature of being able to switch between low volume and high volume modes, this pump is advantageous because it produces an extremely high volume of air per stroke for its overall size.

This invention can be easily applied to a floor pump. Floor pumps are generally free standing pumps with a flexible hose used to inflate tires quickly. Floor pumps generally have larger diameters than portable pumps because the user can apply his or her body weight to the handle so they are able to achieve a relatively high pressure even with a large diameter piston. The problem is, however, that relatively light or weak individuals may not be able to achieve a high pressure, say 120 or 140 psi, using a floor pump. It is advantageous in a floor pump to be able to switch to a low volume/high pressure mode after they can no longer easily continue pumping yet need to achieve a higher pressure.

The dual mode air pump of the present invention, in a preferred mode, comprises outer, middle and inner concentric tubes independently connected to a pump head for air flow therethrough and the outer tube selectably connected to ambient by a sleeve, the threaded position of which determines the mode of pump operation, i.e., high volume or high pressure. In the high volume mode, the sleeve is closed and air from both the outer tube and middle tube is pushed simultaneously by the pump action. In the high pressure mode, the sleeve is opened and air from the outer tube exits through the loosened sleeve. The pumping action pushes air only out of the middle tube which, because of its reduced diameter, incurs lower resistance for any given tire pressure as compared to the combination of the larger diameter outer tube and the middle tube. Various valves, O-rings and seals, assure proper air flow direction in both modes. Other embodiments disclosed herein include dual mode pump above but with the smaller tube configured as a dual action pump so that it pushes air on both the push and pull strokes; a pump with the inner tube selectably connected to ambient by an end cap (instead of the outer tube selectably connected by a sleeve), the threaded position of which determines the mode of pump operation; a pump permanently configured for high volume; and a dual mode floor pump.

OBJECTS OF THE INVENTION

It is therefore a principal object of the invention to provide a compact, dual-mode hand pump having a selectable high volume mode and a selectable high pressure mode and which is not substantially different in size or shape from conventional bicycle pumps.

It is another object of the invention to provide a compact manual pump having a switching device to select either of two modes of operation, one such mode being high volume and the other such mode being high pressure.

It is still another object of the invention to provide a compact, hand pump which pumps a high volume of air with each stroke.

It is still an additional object of the invention to provide a dual mode manual floor pump with selectable switching between a high volume low pressure mode and a low volume high pressure mode.

BRIEF DESCRIPTION OF THE DRAWINGS

The aforementioned objects and advantages of the present invention, as well as additional objects and advantages thereof will be more fully understood hereinafter as a result of a detailed description of preferred embodiments thereof, when taken in conjunction with the following drawings in which.

DETAILED DESCRIPTION OF PREFERRED EMBODIMENTS

Figure 1:
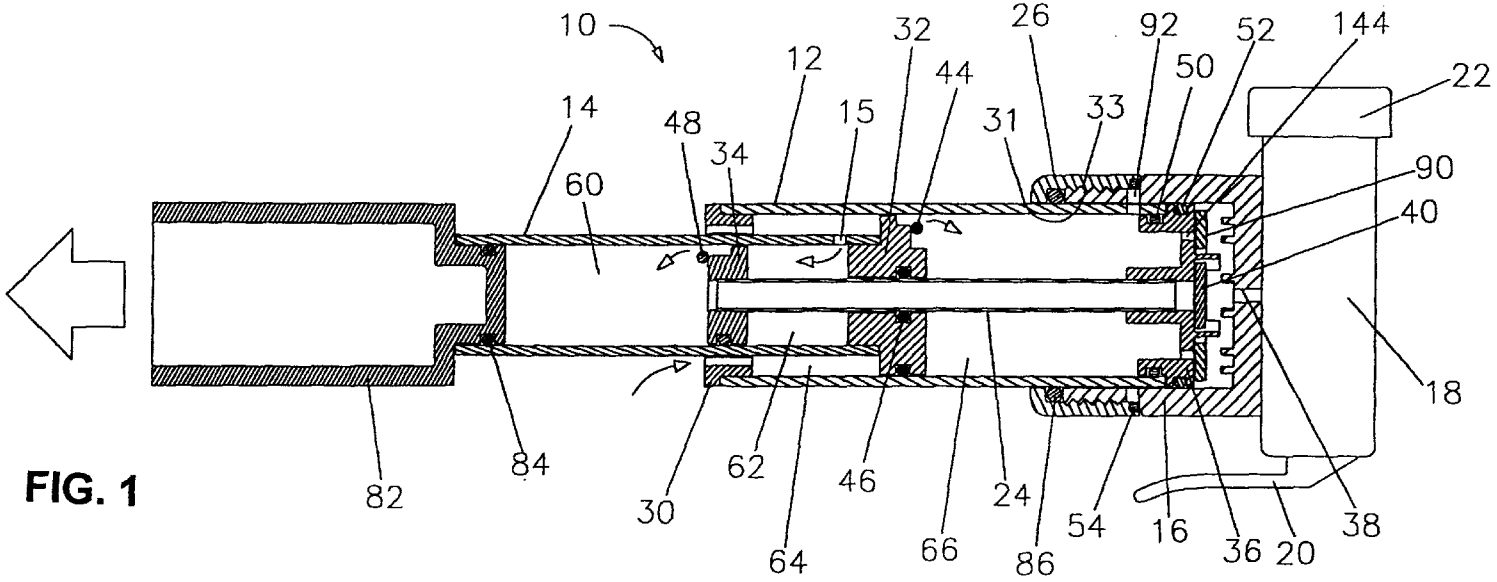
FIG. 1 is a partially cross-sectioned view of a preferred embodiment of the invention shown configured for high volume/low pressure pumping in transition toward full extension.

The preferred embodiment of the present invention may be understood by referring to FIGS. 1–4. It will be seen that a dual mode air pump 10 comprises an outer cylindrical tube 12, a middle cylindrical tube 14 and an inner cylindrical tube 24. A sleeve 26 provides a selectable leak path at one end of tube 12 as will be described hereinafter. A pump head 16 is, in turn, integral to a conventional valve interface 18 having a lever 20 and retainer 22 for attachment to a bicycle tube valve or the like in a well-known manner.

Outer tube 12 is connected to the pump head 16 and comprises a valve 36 and a bushing 30. Middle tube 14 has a first end seal 32 and a second end seal 34.

It will be observed that seal 32 serves as a piston for the outer tube 12 while seal 34 acts as the piston for middle tube 14. Thus, upon each compression of the pump, two separate pistons and corresponding tubes or cylinders deliver air simultaneously to pump head passage 38.

Other structural features of the pump 10 include an air hole 15 in tube 14 adjacent seal 32, an air hole 92 in tube 12 adjacent valve 36, valve interface thread 31 and sleeve thread 33 to selectively secure sleeve 26, and plurality of O-rings 44, 46, 48, 50, 52, 54, 84 and 86 to provide proper sealing during pump operation.

The described structure of pump 10 forms four distinct air chambers which will be referred to hereinafter to help explain the operation of the preferred embodiment. More specifically, a first air chamber 60 is formed within tube 14 between handle 82 and end seal 34. A second air chamber 62 is formed between tubes 14 and 24 and between seals 32 and 34. A third air chamber 64 is formed between tubes 12 and 14 and between bushing 30 and seal 32. A fourth air chamber 66 is formed between tubes 12 and 24 and between seals 32 and 36. Valve flap 40 is a flexible disc and valve flap 90 is washer shaped. The operation of pump 10 will now be described in conjunction with FIGS. 1–4.

High volume/low pressure mode: In this mode, the sleeve 26 is screwed shut which seals the chamber 66 from ambient pressure. Air within both the chamber 60 and chamber 66 is pushed into the pump head 16. Notice that the seals 32 and 34 work simultaneously to propel air into the pump head 16.

In FIG. 1, the pump 10 is in the high volume/low pressure mode and is being pulled open. The pump head one way valve 36 is closed due to tire pressure. The O-ring 44 on the seal 32 slides partially over a corner to allow air to enter the air chamber 66 from ambient through air chamber 64. The O-ring 48 on the seal 34 slides partially over a corner to allow air to enter the air chamber 60 from ambient through air chambers 62 and 64. A hole 15 allows ambient air to pass between chambers 62 and 64.

Figure 2:
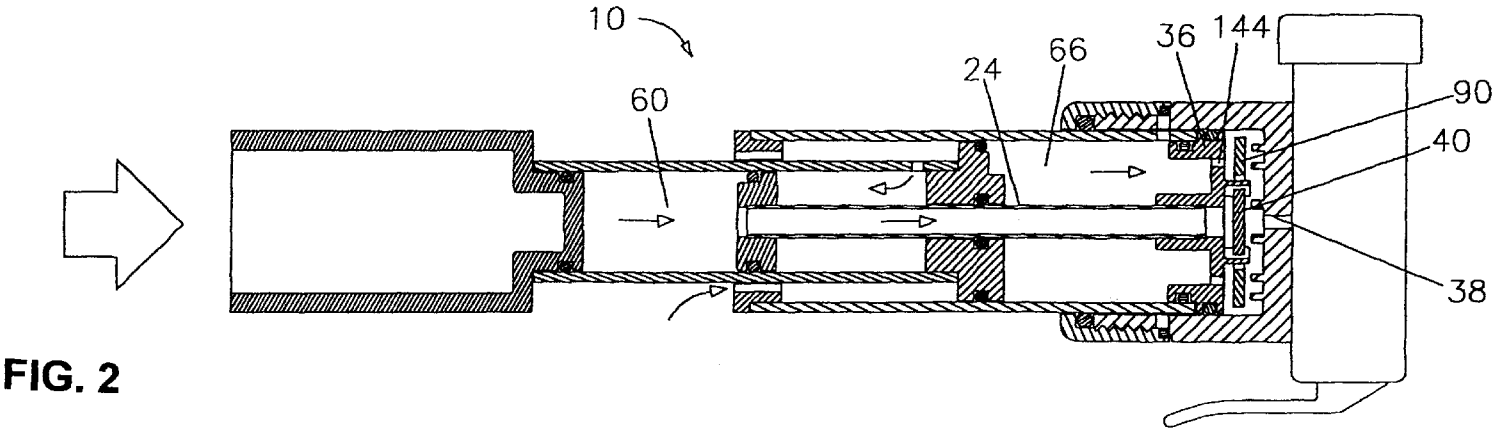
FIG. 2 is a view similar to FIG. 1 but illustrating the invention in transition toward its collapsed condition.

In FIG. 2, the pump 10 is in the high volume/low pressure mode and is being pushed closed. Air from the air chamber 66 pushes through passage 144 into the pump head and into the tire. Air pressure pushes valve flap 90 so that one way valve 36 is open to passage 38 when pump pressure exceeds tire pressure. Air in chamber 60 is pushed down the inner tube 24 into the pump head. Air pressure pushes valve flap 40 so that the one way valve 36 is open to passage 38 when pump pressure exceeds tire pressure.

Low volume/high pressure mode: In this mode, the sleeve 26 is loosened which opens an end of pump 10 to ambient pressure. In this mode, air within the outer tube 12 is pushed through hole 92 out to ambient. Basically, the outer tube 12 no longer pumps air into the tire, but instead pushes the air into ambient. The middle tube 14 pushes air into the pump head which goes into the tire. Effectively, the pump is now a small bore diameter pump capable of higher pressures for the same force input.

Figure 3:
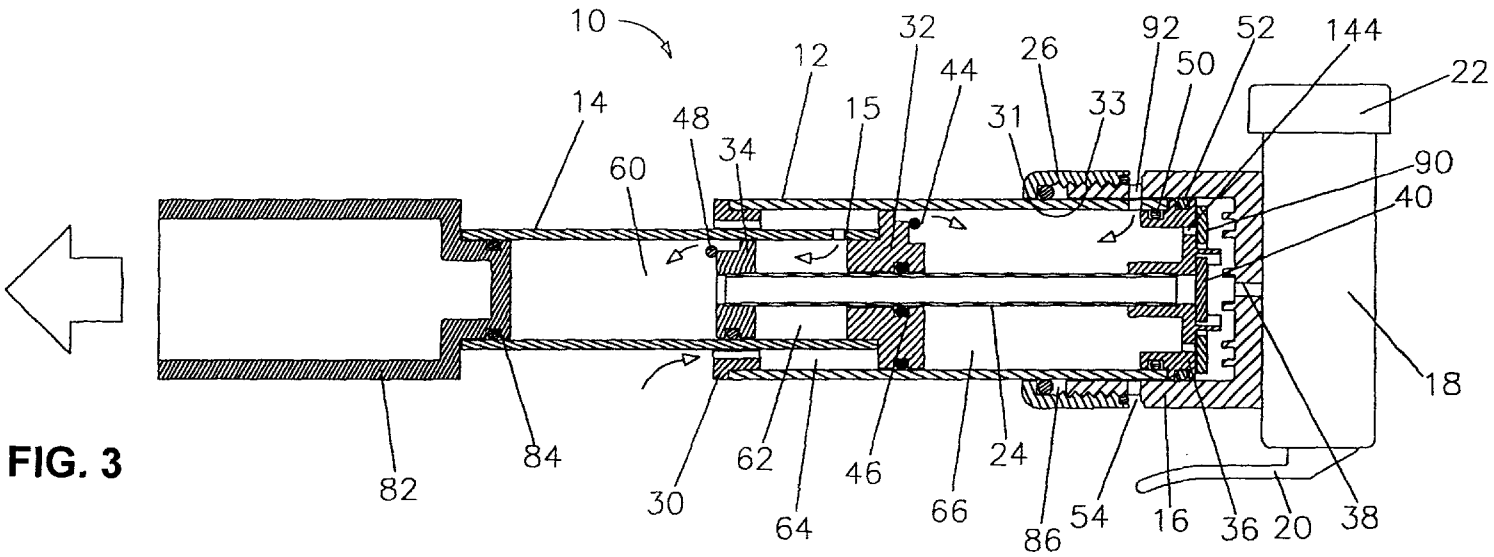
FIG. 3 is a partially cross-sectioned view of a preferred embodiment of the invention shown configured for low volume/high pressure pumping in transition toward full extension.

In FIG. 3, the pump 10 is in the low volume/high pressure mode and is being pulled open. The pump head one way valve 36 is closed. Air fills the air chamber 66 from ambient through hole 92 and/or air fills the chamber 66 from ambient chamber 64 by the O-ring 44 sliding partially over a corner of seal 32. The O-ring 48 on the seal 34 slides partially over a corner to allow air to enter the air chamber 60 from ambient through air chambers 62 and 64.

Figure 4:
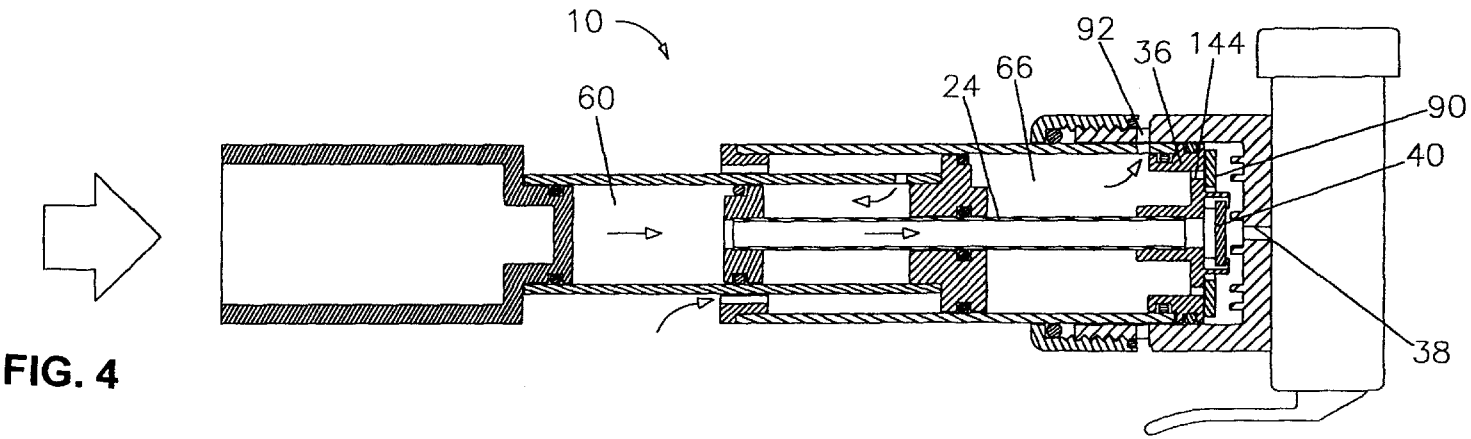
FIG. 4 is a view similar to FIG. 3, but illustrating the invention in transition toward its collapsed condition.

In FIG. 4, the pump 10 is in the low volume/high pressure mode and is being pushed closed. Air from chamber 66 is being forced out to ambient through hole 92. Valve flap 90 is forced by tire pressure to close passage 144 of the one way valve 36. Air in chamber 60 is pushed down the inner tube 24 into the pump head. Air pressure pushes valve flap 40 so that the one way valve 36 is open to passage 38 when pump pressure exceed tire pressure.

Figure 5:
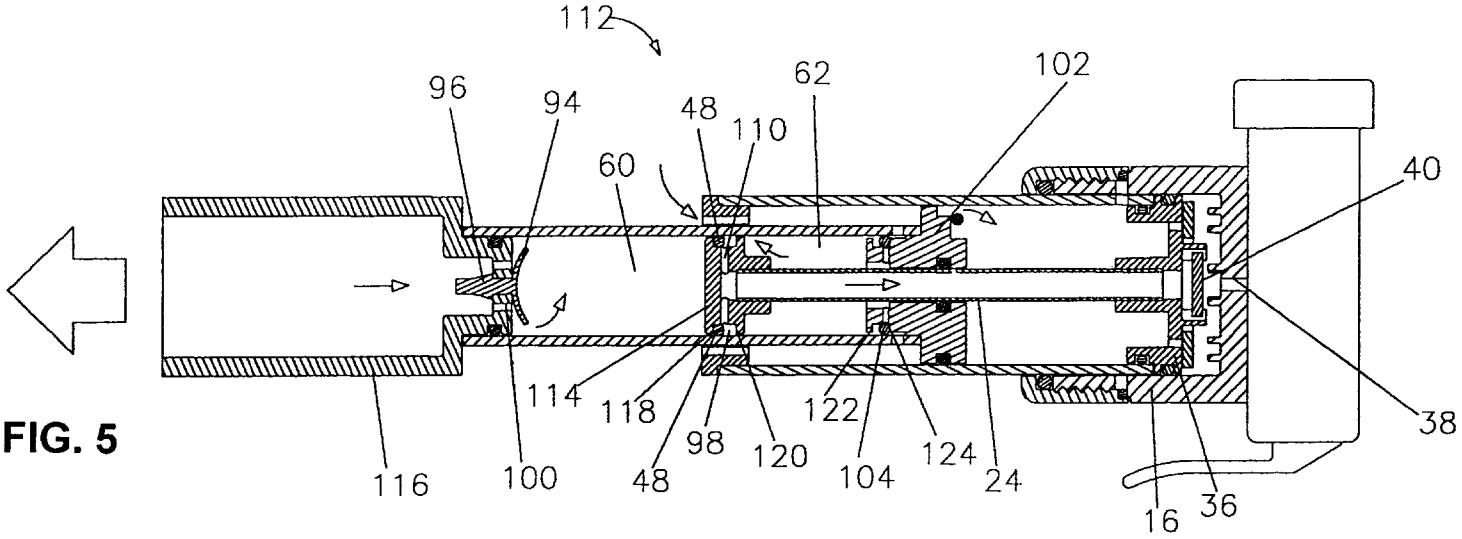
FIG. 5 is a partially cross-sectioned alternative embodiment of the invention in transition toward full extension which is a dual mode pump with the smaller tube configured as a dual action pump so that it pushes air on both the push and pull strokes.

The embodiment 112 of FIG. 5 is similar to the embodiment of FIGS. 1–4, but is altered to the configuration of a double action pump. The operation of pump 112 is similar to pump 10 except that during the pulling open phase, air within chamber 62 is pushed through end seal 114 into inner tube 24 into the pump head 16 which goes into the tire. End seal 102 is a one way valve. Handle 116 has a valve stem 96 and a valve flap 94 to permit one direction air flow into chamber 60 from ambient. Embodiment 112 pushes the same volume of air into the tire on the push phase as described in conjunction with FIGS. 1 and 2, but in addition it pushes air from chamber 62 into the tire during the pull phase. Embodiment 112 is an especially high volume pump in the high volume/low pressure mode, it pumps more air per stroke cycle because it pushes air even during the pulling phase.

In FIG. 5, the pump 112 is in the high volume/low pressure mode and is being pulled open. Seal 48 slides against surface 118 of end seal 114. Seal 104 slides against surface 124 closing end seal 102 one way valve. Air within chamber 62 is pushed into chamber 98 into hole 110 into inner tube 24 into the pump head. As in FIGS. 1–4, air pressure pushes valve flap 40 so that the one way valve 36 is open to passage 38 when pump pressure exceeds tire pressure. Air fills chamber 60 from ambient through hole 100 through a one way valve flap 94.

Figure 6:
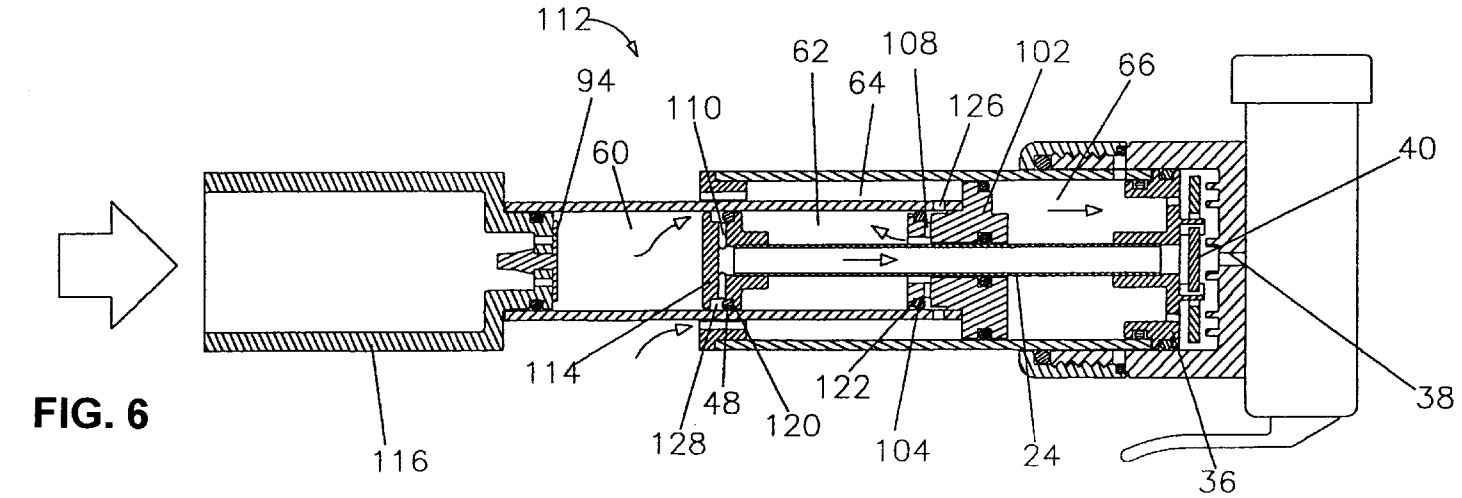
FIG. 6 is a view similar to FIG. 5, but illustrating the invention in transition toward its collapsed condition.

In FIG. 6, the pump 112 is in the high volume/low pressure mode and is being pushed closed. Seal 48 slides against surface 120 of end seal 114. Seal 104 slides against surface 122 opening end seal 102 one way valve. One way valve flap 94 closes against handle 116. Air enters chamber 62 from ambient chamber 64 through holes 126 and 108 and through the one way valve of end seal 102. Air within chamber 60 is pushed into chamber 128, through hole 110, and down inner tube 24 into the pump head. As in FIGS. 1–4, air pressure pushes valve flap 40 so that the one way valve 36 is open to passage 38 when pump pressure exceeds tire pressure. Air within chamber 66 is pushed into the pump head as in FIGS. 1 and 2.

Figure 7:
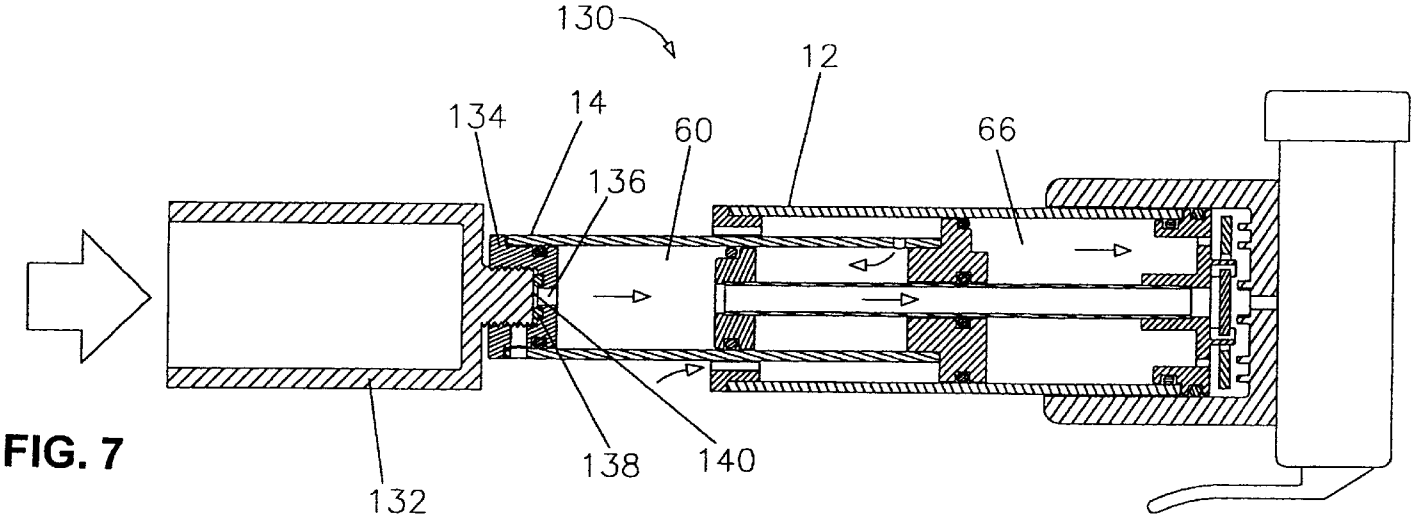
FIG. 7 is a partially cross-sectioned additional embodiment of the invention which is configured with an alternative switch location for high volume/low pressure pumping in transition toward its collapsed extension.
Figure 8:
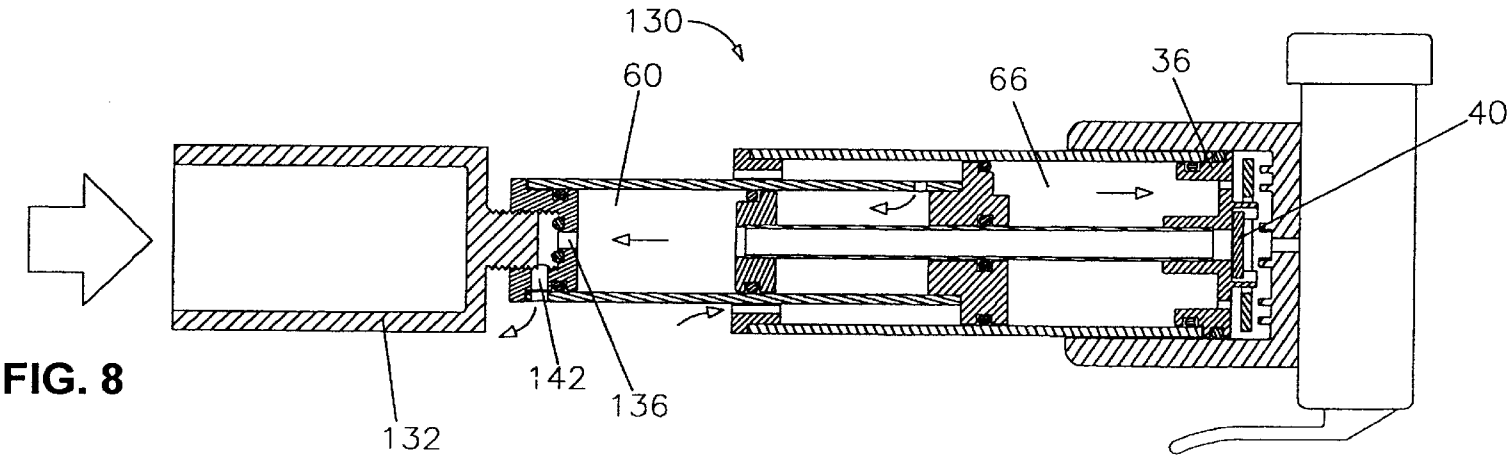
FIG. 8 is a partially cross-sectioned additional embodiment of the invention which is configured with an alternative switch location for low volume/high pressure pumping in transition toward its collapsed extension.

The embodiment 130 of FIGS. 7 and 8 is similar to the embodiment of FIGS. 1–4, but with the mode switch relocated to the handle end of the pump. Instead of the outer tube 12 being selectably exposed to ambient, the middle tube 14 is selectably exposed to ambient. When the handle 132 is moved relative to the end seal 134, air within chamber 60 is pushed to ambient and air within chamber 66 is pushed into the pump head.

In FIG. 7, the pump 130 is in the high volume/low pressure mode and is being pushed closed. Surface 140 of handle 132 seals against seal 138 and end seal 134 to prevent air flow through hole 136. Air flows into the pump head virtually identically to the embodiment of FIG. 2.

In FIG. 8, the pump 130 is in the low volume/high pressure mode and is being pushed closed. Handle 132 is loosened which opens an end of pump 130 to ambient pressure. Air within chamber 66 is pushed into the pump head identically to the embodiment of FIG. 2. Air within chamber 60 flows through holes 136 and 142 to ambient. Tire pressure seals valve flap 40 against valve 36.

Figure 9:
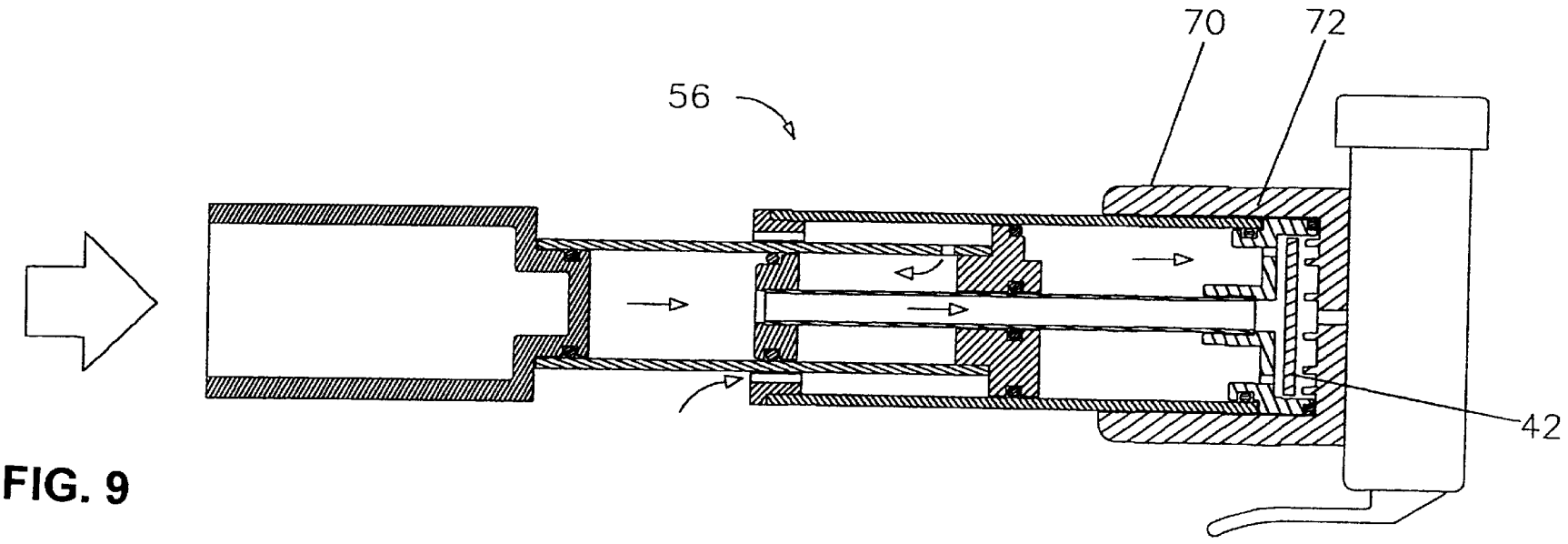
FIG. 9 is a partially cross-sectioned additional embodiment of the invention which is permanently configured as a high volume pump.

The embodiment 56 of FIG. 9 is virtually identical to the embodiment of FIGS. 1–4 except that sleeve 70 is made as an integral part of pump head 72 rendering valve interface thread 31 and sleeve thread 33 of FIGS. 1–4 unnecessary. Also, seals 86 and 36 are unnecessary and omitted. A single valve flap 42 replaces independent valve flaps 40 and 90. As a result, the embodiment of FIG. 9 is permanently in the high volume configuration equal to the configuration of FIGS. 1 and 2. An embodiment of the configuration of FIG. 9 may be advantageous for users who prefer or need only high volume air pumping in a relatively compact configuration.

Figure 10:
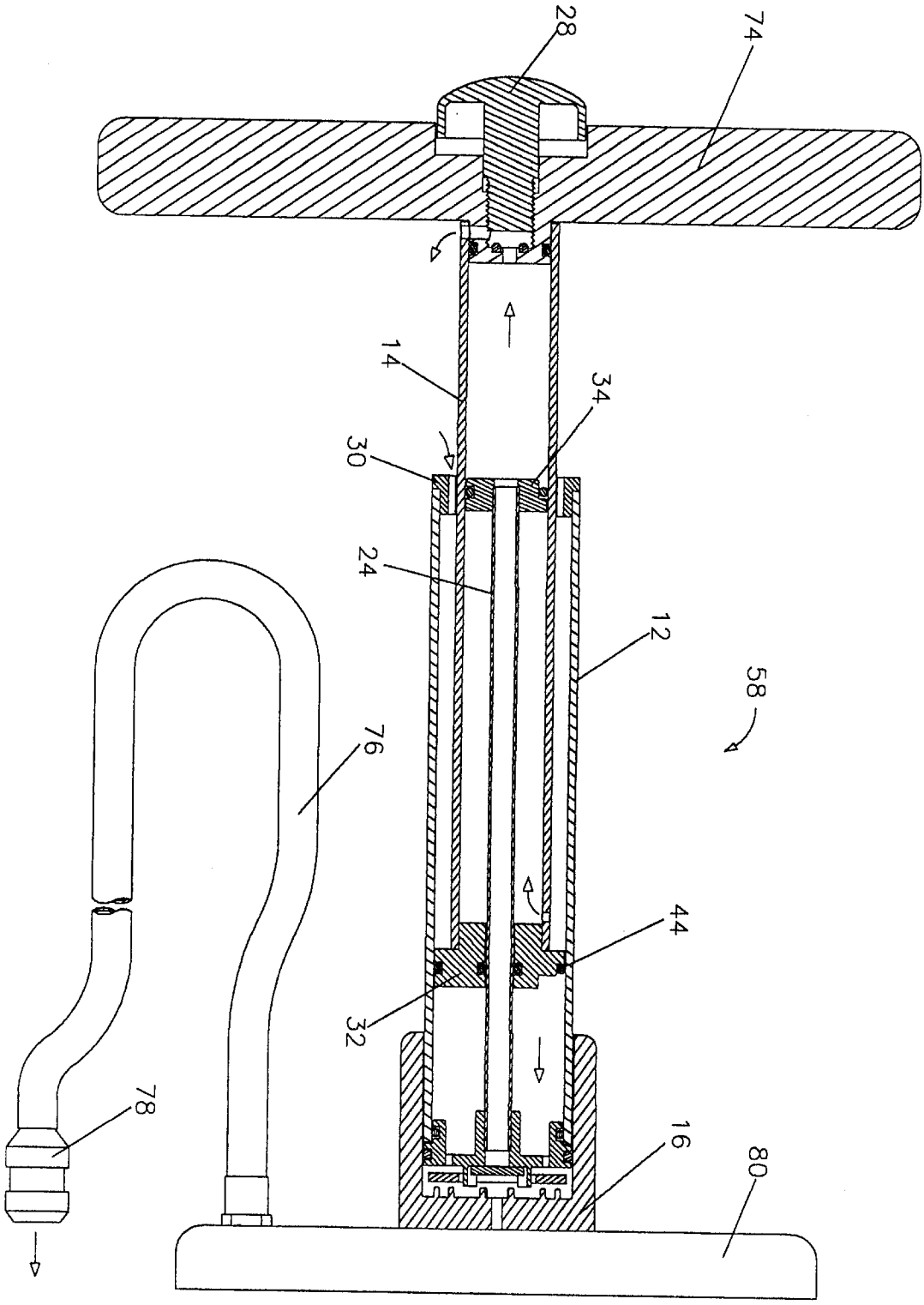
FIG. 10 is a partially cross-sectioned additional embodiment of the invention which is configured as a dual mode floor pump.

The embodiment 58 of FIG. 10 is virtually identical to the embodiment of FIGS. 7 and 8, but is altered to the configuration of a floor pump. The operation of pump 58 is in all respects identical to that of hand pump 130. An end cap 28, a handle with end seal 74, a hose 76, valve attachment 78, and pump head 16 connected through a floor support base 80 are added. Similarly, a floor pump could be configured to be virtually identical to embodiment of FIGS. 1–4.

Those having ordinary skill in the art of pumps will now, as a result of the disclosure herein, conceive various additions and modifications which may be made to the invention. By way of example, other devices for switching between modes may be used such as a device for limiting rotation of an end cap or rocker arm that may or may not block a flow passage to ambient. In addition one may readily conceive of an automatic switch device which selects the high pressure mode at a preselected pressure (e.g., 60 psi) after a nominal selection of the high volume mode at lower pressures. Also, it will be understood that the relative dimensions of the two cylinders or tubes may be readily altered to provide different degrees of relative change between the two modes. Accordingly, all such additions and modifications are deemed to be within the scope of the invention which is to be limited only by the appended claims and their equivalents.

We claim:

1. A manually operated air pump of the type terminating in a valve for connection to a device to be inflated and comprising:

a middle tube closed at one end;

an inner tube concentrically positioned within said middle tube and communicating with said closed one end of said middle tube;

an outer tube receiving said middle and inner tubes, said middle tube being moveable coaxially relative to said outer and inner tubes;

a first seal at an end of said middle tube forming a moveable piston within said outer tube for driving air toward said device to be inflated;

a second seal at an end of said inner tube forming a moveable piston within said middle tube for driving air through said inner tube into said device to be inflated, said second seal having a one way valve;

said outer tube forming a chamber for selectively directing air from said outer tube into said device to be inflated or through an opening to ambient;

a device for selectively closing and opening said chamber of said outer tube for either sealing or unsealing said chamber for corresponding high volume or high pressure operation of said pump.

2. The air pump recited in claim 1 wherein said device for selectively sealing and unsealing said chamber of said first chamber comprises a threaded sleeve.

3. The air pump recited in claim 1 further comprising a floor base on said valve and a handle on said middle tube for configuring said pump as a floor pump.

* * * * *